United States Patent [19]

Giambrone et al.

[11] 3,949,933

[45] Apr. 13, 1976

[54] COLLAPSIBLE CONTAINER

[75] Inventors: Harry J. Giambrone; Robert L. Naas, both of Kettering, Ohio

[73] Assignee: Baxter Laboratories, Inc., Deerfield, Ill.

[22] Filed: Dec. 30, 1974

[21] Appl. No.: 537,239

[52] U.S. Cl. ..... 229/50; 229/41 R
[51] Int. Cl.[2] ..... B65D 5/42
[58] Field of Search ..... 229/41 R, 50

[56] References Cited

UNITED STATES PATENTS

| | | | |
|---|---|---|---|
| 268,542 | 12/1882 | Ruckert | 229/50 |
| 523,038 | 7/1894 | Jowett | 229/50 |
| 676,393 | 6/1901 | Drawbaugh | 229/50 X |
| 1,063,488 | 6/1913 | Wilson | 229/50 |
| 1,100,716 | 6/1914 | Droz | 229/50 X |
| 1,160,871 | 11/1915 | Forward | 229/50 X |
| 1,821,307 | 9/1931 | Howland | 229/50 X |

*Primary Examiner*—Davis T. Moorhead
*Attorney, Agent, or Firm*—Richard G. Kinney

[57] ABSTRACT

A collapsible container comprising substantially identical, oppositely disposed top and bottom panels, each having at least three edges, a pair of side wall panels for each of these edges, each pair comprising upper and lower panels having edges hingedly connected to the top and bottom panels respectively along associated edges thereof, the upper and lower panels being hingedly interjointed along interconnection edges thereof and being adjacently disposed outwardly of the top and bottom panels when the container is collapsed. The container further comprises tube means disposed along the interconnection edges, and a string disposed within said tube means, whereby drawing the string serves to erect the container by retracting the side wall panels inwardly to vertically separate the top and bottom panels. Alternatively, a rigid frame or other suitable means may be used in place of the tube and draw string.

17 Claims, 13 Drawing Figures

FIG.1
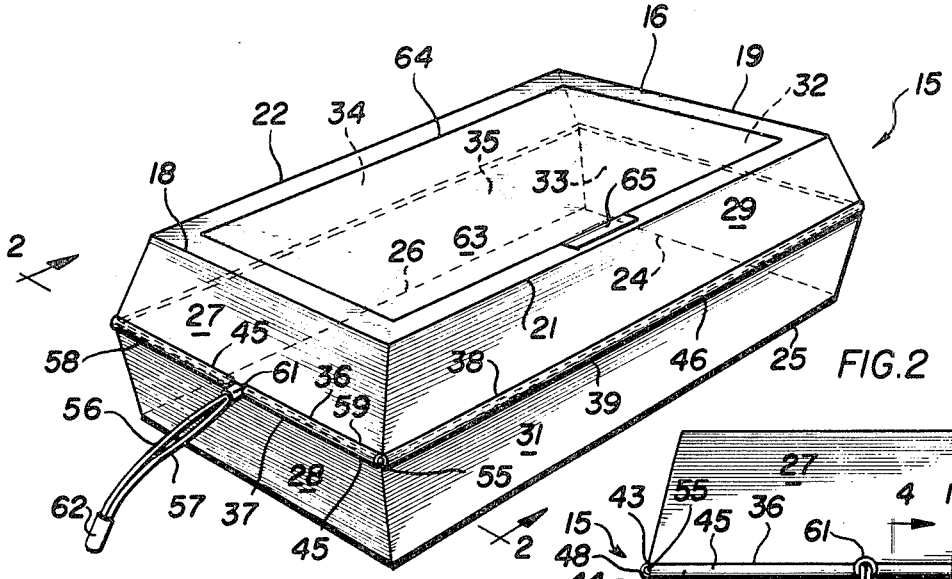
FIG.2
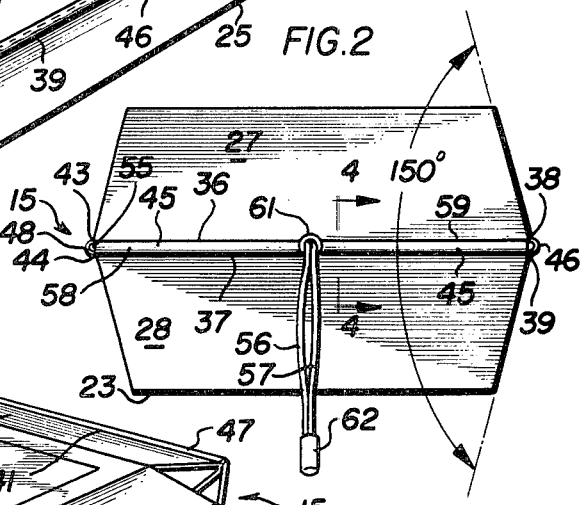
FIG.3
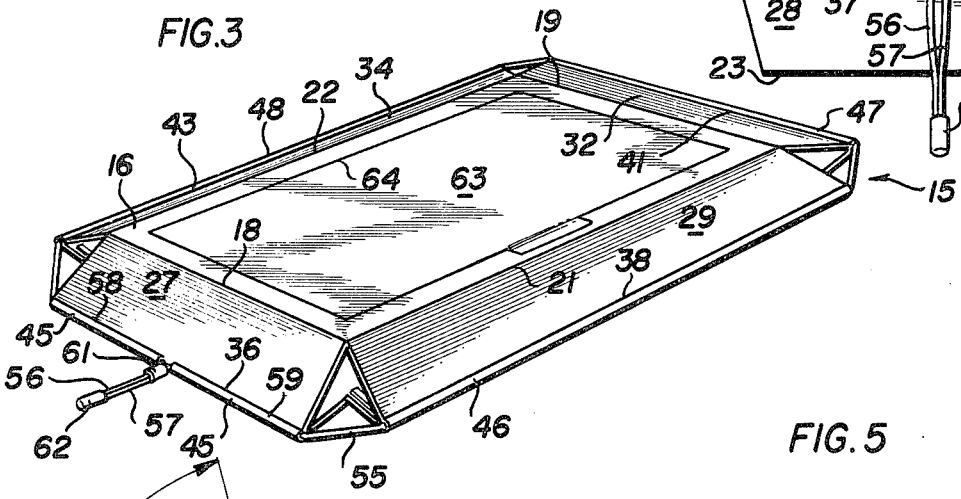
FIG.5
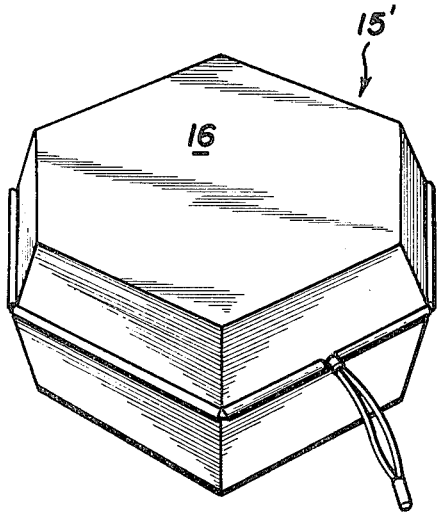
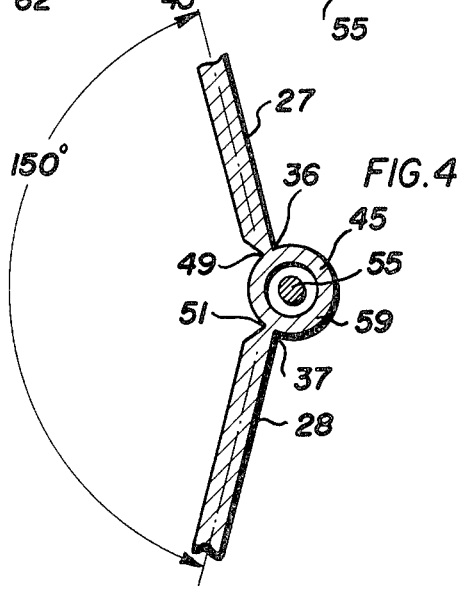
FIG.4

COLLAPSIBLE CONTAINER

BACKGROUND OF THE INVENTION

1. Field of the Invention

The present invention relates to a novel and improved collapsible container.

2. Description of the Prior Art

The folding box disclosed in U.S. Pat. No. 1,114,803 comprises a box suitable for use as a shipping container and having loose foldable flaps. However, access to this box requires tearing its walls or cutting its tied cord, thereby preventing multiple container collapsing operations.

U.S. Pat. Nos. 1,362,129; 1,501,913; and 1,555,054 disclose collapsible boxes or containers, each having a separate lid or cover in addition to a main body portion. Furthermore, containers disclosed in these patents are of complicated design, and are relatively difficult to erect and collapse.

U.S. Pat. No. 1,509,454 discloses a collapsible lunch box having a foldable cover or lid. However, this container is also of complicated design, and is relatively difficult to erect.

SUMMARY OF THE INVENTION

The present invention comprises a simple, inexpensive, readily erected or collapsed, and structurally sturdy container. The present invention is collapsible to a flat structure for easy storage, and is easily erected into a container by a simple single step, in contrast to multiple steps necessary to erect prior known folding containers. The container can be applied to various uses, and is suitable, for example, for use as a toiletries kit container, shoe tote, or reusable package for merchandise.

In general, the present invention comprises a collapsible container having at least one base panel and preferably top and bottom panels, having at least three edges, at least one side wall panel for each of these edges, and hingedly connected to the base panel respectively along associated edges thereof, the base panel being hingedly interjoined along interconnection edges thereof and being adjacently disposed outwardly of the base panel when the container is collapsed. The sides of each of the side wall panels are so arranged as to abut against the adjacent side wall panels when both are pivoted out of the plane of the base. The container further comprises rigidifying means for restraining the side wall panels in their abutting position. All of the mentioned panels are preferably made of a relatively rigid material to afford protection for contents contained in the container.

In accordance with one feature of the invention, the rigidifying means may be a simple draw string (or other flexible, relatively nonstretching member) encircling the interconnection edge in a tube or sleeve. By simply drawing down the string and shortening its length, the side walls of the container may be caused to move together and abut each other and the container become rigid.

In accordance with another feature of the invention, the rigidifying means may be a rigid frame sized and shaped to the outline of the erected container, which may be pivoted at one outer edge of the sidewall thereof, and pivoted over the remainder of the outer edges of the side walls when they are moved into the erected configuration.

The features of the present invention which are believed to be novel are set forth in the appended claims and reference should also be made to those features. The invention, together with further advantages thereof, can be better understood by referring to the following description taken in connection with the accompanying drawings, in the several figures of which like reference numerals identify like elements.

BRIEF DESCRIPTION OF THE DRAWINGS

FIG. 1 is a perspective view illustrating the basic features of the preferred embodiment of the collapsible container of the present invention, shown in its erect position;

FIG. 2 is an end elevation view taken substantially along the line 2—2 of FIG. 1;

FIG. 3 is a perspective view of the collapsible container shown in FIGS. 1 and 2, illustrated in its collapsed position;

FIG. 4 is a view taken substantially along the line 4—4 of FIG. 2 with parts broken away, illustrating the interconnection edges of a single pair of upper and lower side wall panels and a string-containing tube means;

FIG. 5 is a perspective view illustrating an alternate embodiment of the present invention having six sides;

DESCRIPTION OF THE PREFERRED EMBODIMENTS

Figure 6:
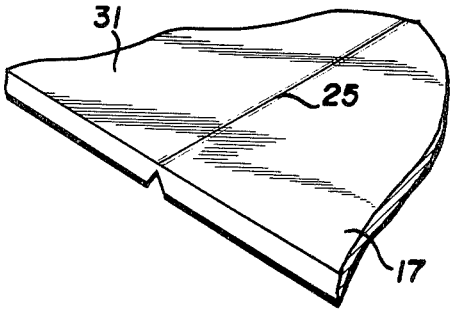
FIG. 6 is a perspective view illustrating the preferred hinged connection between a side wall panel and one of the top and bottom panels when the container is in collapsed position.

As best shown in FIGS. 1, 2, 7, and 9, the preferred embodiment of the present invention comprises a collapsible container, generally designated by reference numeral 15, having a top horizontal rectangular panel 16 (FIG. 1) and a substantially identical oppositely disposed horizontal bottom panel 17 (FIG. 9), the top panel having opposing pairs of edges 18, 19 and 21, 22, with the bottom panel having opposing pairs of edges 23, 24 and 25, 26.

Figure 9:
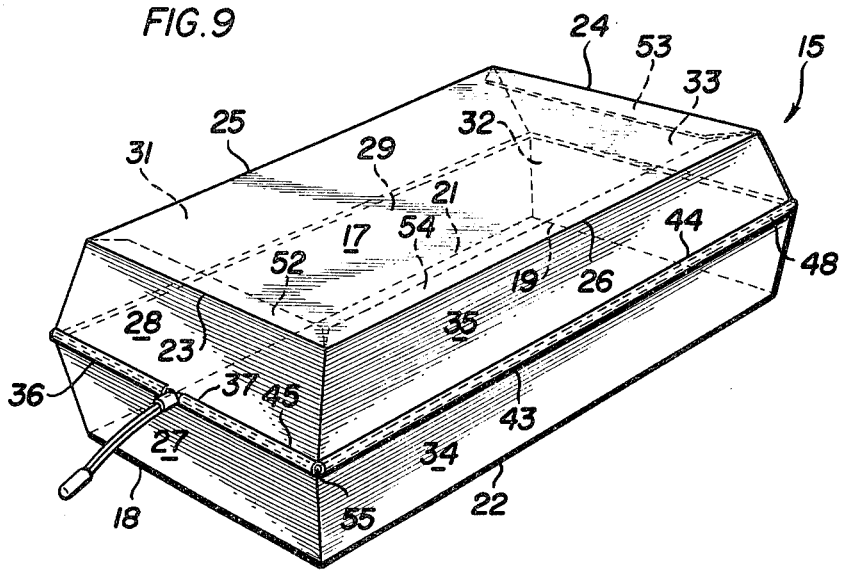
FIG. 9 is a perspective view showing the bottom of the collapsible container.

Container 15 comprises a pair of collapsible upper and lower side wall panels for each of the four edges of the rectangular top and bottom panels 16, 17. An upper side wall panel 27 and a lower side wall panel 28 are provided for corresponding upper and lower edges 18 and 23 (FIGS. 1, 2 and 9). Similarly, an upper side wall panel 29 and a lower side wall panel 31 are provided for corresponding upper and lower edges 21 and 25. An upper side wall panel 32 and a lower side wall panel 33 are provided for corresponding upper and lower edges 19 and 24. Finally, an upper side wall panel 34 and a lower side wall panel 35 are provided for corresponding upper and lower edges 22 and 26. All of the panels are preferably constructed of a relatively rigid material, such as injection molded plastic or cardboard, in order to provide protection for container contents.

Each top and bottom panel of the collapsible container of the present invention contains at least three edges thereof, a pair of side wall panels being provided for each of these edges.

The upper and lower side wall panels of each pair thereof have edges hingedly connected or otherwise flexibly joined to top and bottom panels respectively, along associated edges thereof. Upper panel 27 has an upper horizontal edge hingedly connected to top panel 16 along edge 18 thereof, while lower side wall panel has a lower horizontal edge hingedly connected to bottom panel 17 along edge 23, as best shown in FIGS. 1, 2, and 9. Similarly, upper side wall panel 29 has an upper edge hingedly connected to top panel 16 along edge 21, and lower side wall panel 31 has a lower edge hingedly connected to bottom panel 17 along edge 25. Upper side wall panel 32 has an upper edge hingedly connected to top panel 16 along edge 19, and lower side wall panel 33 has a lower edge hingedly connected to the bottom panel 17 along edge 24. Finally, upper side wall panel 34 has an edge hingedly connected to top panel 16 along edge 22, while lower side wall panel 35 has a lower edge hingedly connected to bottom panel 17 along edge 26. Each hinged connection between these adjoining panels preferably comprises a V-shaped groove shown in FIG. 6, the inverted V opening toward the interior of container 15.

Figure 7:
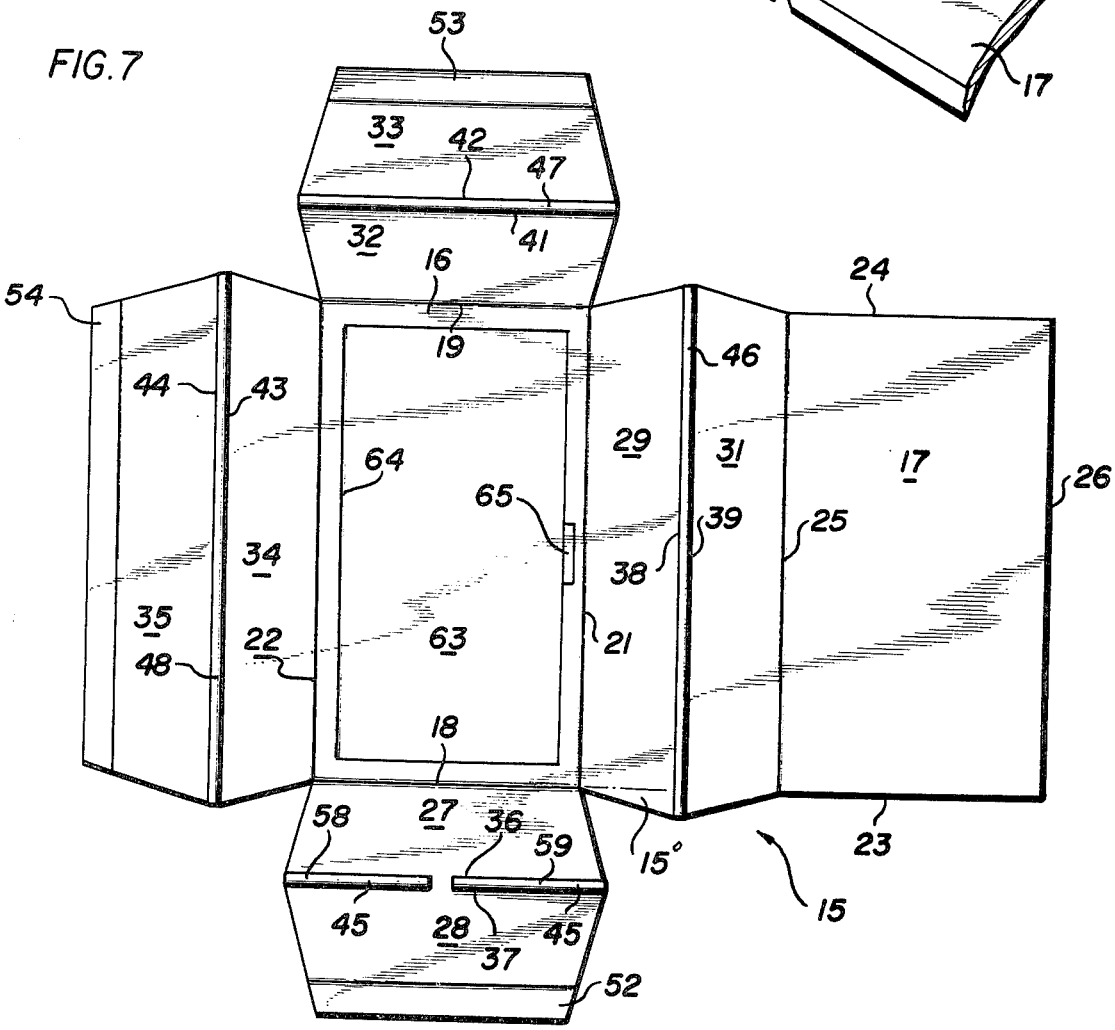
FIG. 7 is a top plan view of a collapsed and disassembled container, showing the preferred integral interconnection between various component parts thereof.

The upper and lower panels in each pair are hingedly interjoined along interconnection edges thereof, as best illustrated in FIGS. 1, 2, 3, 7, and 9. Upper side wall panel 27 is hingedly interjoined with lower side wall panel 28 along interconnection edges 36 and 37 respectively. Similarly, upper side wall panel 29 and lower side wall panel 31 are hingedly interjoined along interconnection edges 38 and 39 respectively. Upper side wall panel 32 and lower side wall panel 33 are hingedly interjoined along interconnection edges 41 and 42 thereof respectively. Finally, upper side wall panel 34 and lower side wall panel 35 are hingedly interjoined along interconnection edges 43 and 44 thereof respectively. The upper and lower side wall panels in each pair thereof are preferably identical, with the interconnection edges being longer than the other hingedly connected edges, such that the side wall panels are disposed outwardly of the top and bottom panels 16, 17 when container 15 is erected. As shown in FIG. 7, typical interconnection edge 38 is offset 15° with respect to its upper edge, which is coextensive with edge 21.

A tube means is disposed longitudinally along associated pairs of interconnection edges, preferably exteriorly of the side wall panels, and integrally formed therewith. A tube means 45 is longitudinally disposed along interconnection edges 36 and 37, as best shown in FIGS. 1, 2, 3, 4, 7, and 9. Similarly, a tube means 46 is disposed along interconnection edges 38 and 39. A tube means 47 is disposed along interconnection edges 41 and 42. Finally, a tube means 48 is disposed along interconnection edges 43 and 44. With reference to FIG. 4, which illustrates a portion of the upper and lower side wall panels 27 and 28, tube means 45 is preferably integrally formed with panels 27 and 28 exteriorly thereof at interconnection edges 36 and 37, thereby effecting hinged interconnection between the upper and lower side wall panels and pivotal rotation thereof about upper and lower pivot or bend points 49 and 51 respectively. Similar structure is provided for other tube means 46, 47, and 48.

In FIG. 6 the typical hinge construction is depicted. In this particular case the hinge 25 is formed by a V-shaped groove between the panels 17 and 31. Of course, other hinge constructions may be employed without departing from at least the broader principles of the present invention.

As best shown in FIG. 7, upper side wall panels 27, 29, 32, and 34 are preferably integrally formed with top panel 16 to facilitate manufacturing of the container 15, lower side wall panel 31 being integrally formed with bottom panel 17. With reference to FIGS. 7 and 9, integrally attached to lower side wall panels 28, 33, and 35 are provided tabs 52, 53, and 54 respectively, for connection to the bottom panel 17 on the inner side thereof along edges 23, 24, and 26 respectively, such as by gluing, upon container assembly.

As best shown in FIG. 3, the upper and lower panels in each paid thereof are adjacently disposed outwardly of the top and bottom panels 16, 17 when the container 15 is in a flat or collapsed position. A tightening string means 55 (FIGS. 1, 2, 3, 4, 9, 10, and 11) made of any suitable material such as jute cord, nylon or wire and having ends 56 and 57 thereof is threadedly disposed or housed within all of the tube means 45, 46, 47, 48 around the outside of container 15, whereby drawing the string serves to erect the container 15 by retracting the side wall panels inwardly (from their FIG. 3 position) to vertically separate the top and bottom panels 16 and 17 (to assume their FIGS. 1, 2, and 9 position). As best shown in FIGS. 1, 2, 3, and 7, tube means 45 preferably comprises two spatially separated tube sections 58 and 59, the ends 56 and 57 of string 55 being threaded through a bead 61 and interjoined by a clasp 62, whereby container 15 is very easily erected by holding the string ends with one hand and tightening or drawing the string by sliding the bead into position against edges 36 and 37 with the other hand. Container 15 is easily collapsed by simply sliding bead 61 away from edges 36 and 37. Thus, structurally sound corners are provided by means of drawstring 55.

Each edge of each side wall panel is preferably coextensive with the edge hingedly connected thereto, and the side wall panels in each pair thereof are preferably substantially identical in size, such that upon side wall panel retraction, the panels are disposed in perpendicular end-to-end relationship to form corners of a closed container, the panels being preferably beveled to form simple 45° miter joints. Of course, any other suitable type of butt or overlap mating could be used, including use of edge liners or rubber inserts to render container 15 watertight. With particular reference to FIGS. 2 and 4, it is seen that typical upper and lower side wall panels 27, 28 are angularly disposed 150° with respect to each other and outwardly of the top and bottom panels 16, 17 when container 15 is in its erect position, since interconnection edges 36, 37 are slightly longer than edges 18, 23 of the top and bottom panels 16, 17 respectively, edges 18, 23 being coextensive with the upper and lower edges of the upper side wall panel 27 and the lower side wall panel 28 respectively. Maintenance of the collapsible side wall panels outwardly with respect to the top and bottom panels 16, 17 prevents their collapsing inwardly, and also facilitates collapsing of container 15.

Figure 8:
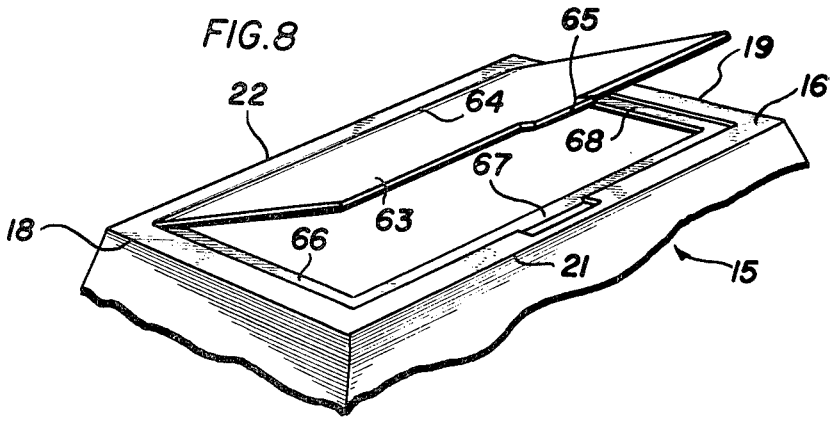
FIG. 8 is a perspective view illustrating an access door in the top of the collapsible container.

As best shown in FIGS. 1, 7, and 8, collapsible container 15 preferably comprises an access door 63 hingedly disposed in top panel 16 along an edge 64 parallel to edge 22, the access door having a tab handle 65 to facilitate opening thereof. In order to retain access door 63 in generally flush relationship with its associated panel 16 when closed, retaining tabs 66, 67, and 68 are attached to top panel 16 on the interior side thereof.

Figure 10:
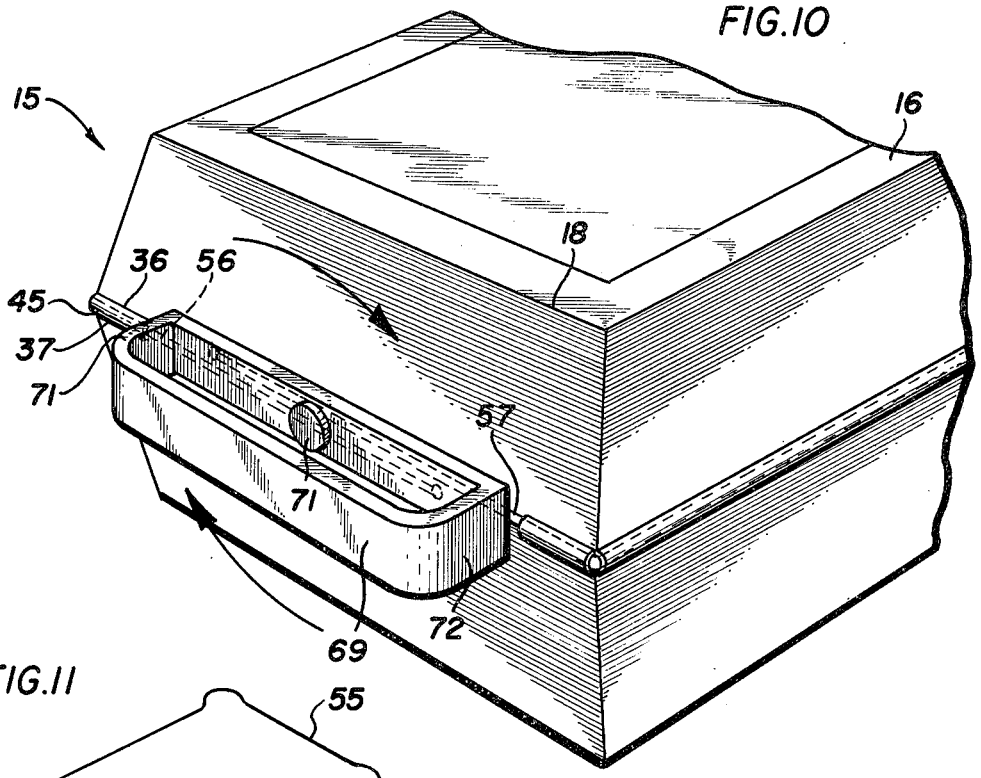
FIG. 10 is a perspective view with parts broken away, illustrating a collapsible container having a rotatable handle for erection thereof.
Figure 11:
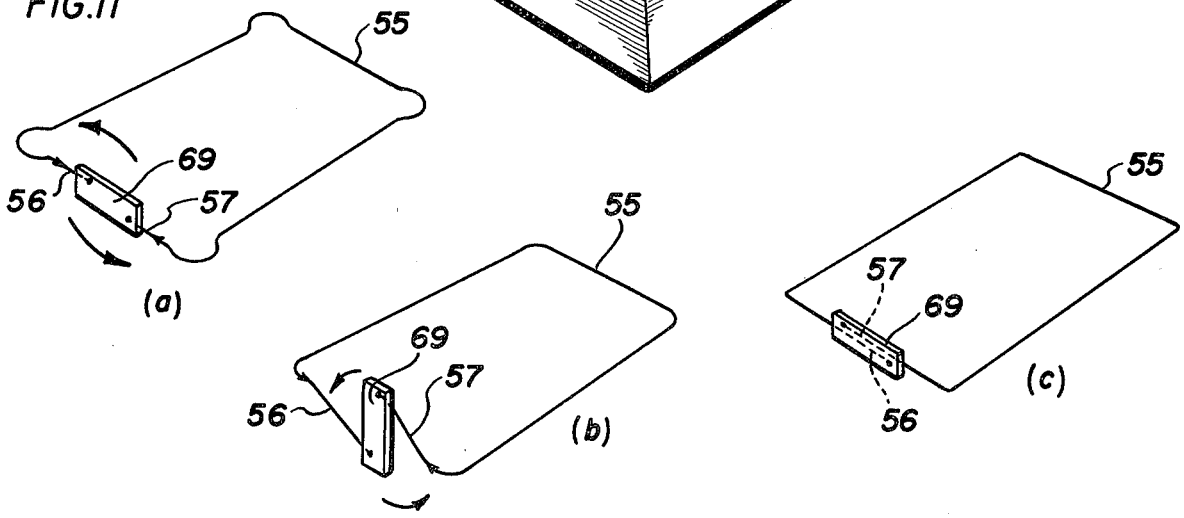
FIG. 11 illustrates string drawing upon rotation of the handle of the container illustrated in FIG. 10.

With reference to FIG. 10, as an alternative to using a bead 61 to facilitate drawing string 55, typical side wall panel 27 comprises a rotatable handle 69 mounted to rotate about a pivot point 71 about an axis normal to side wall panel 27, opposite ends 56 and 57 of the string 55 being connected to opposite sides 71, 72 of the handle respectively, whereby rotation of the handle serves to retract the pairs of side wall panels inwardly to erect the container, as illustrated in FIG. 11. FIG. 11(*a*) illustrates string 55 in its extended position when container 15 is collapsed. As handle 69 is rotated counter-clockwise as viewed in FIG. 11(*b*) to erect container 15, string 55 is drawn or tightened. As shown in FIG. 11(*c*), which illustrates string 55 upon container erection, end 57, which was formerly at the right-hand side of container 15, assumes a left-hand position; similarly, handle rotation draws left end 56 rightward, thereby tightening or drawing the string.

With reference to FIG. 5, an alternate embodiment 15' of the present invention comprises hexagonal top panel 16' and bottom panel and six pairs of upper and lower side wall panels.

Figure 12:
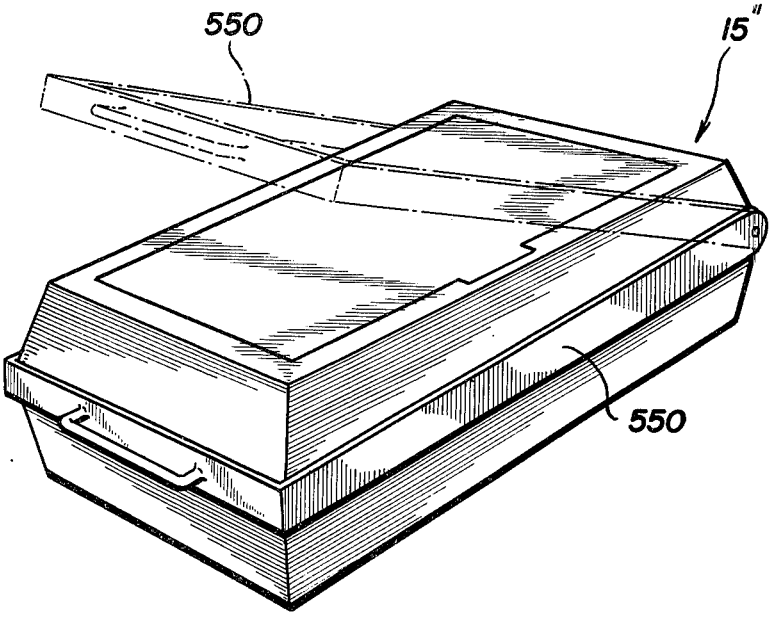
FIG. 12 is a perspective view similar to FIG. 1 of another alternative construction for a container incorporating features of the present invention.
Figure 13:
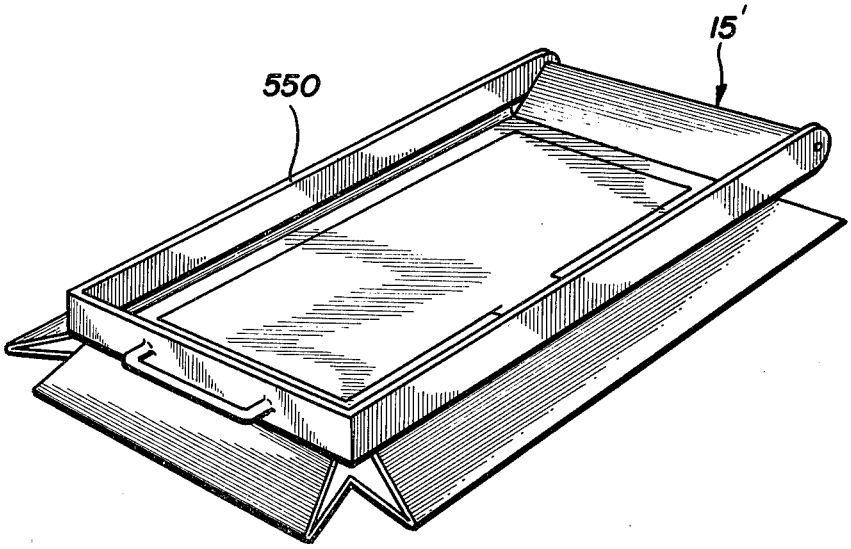
FIG. 13 is a perspective view similar to FIG. 3 of the alternative embodiment of FIG. 12 in its collapsed state.

FIGS. 12 and 13 illustrate a further modification, wherein instead of the drawstring 55, a rigid frame 550, corresponding to the shape of the rigid container about its lateral edges, is provided as the rigidifying means. Although this embodiment does not collapse as flat as that of previous embodiment, it has the advantage of even greater rigidity in the erect state.

It is thought that the invention and many of its attendant advantages will be understood from the foregoing description, and it is apparent that various changes may be made in the form, construction, and arrangement of its component parts without departing from the spirit and scope of the invention or sacrificing all of its material advantages, the form described being merely a preferred embodiment thereof.

The embodiments of the invention in which an exclusive property or privilege is claimed are defined as follows:

1. An expansible and collapsible container comprising: substantially identical, oppositely disposed top and bottom panels of polygonal shape, side wall panels attached to sides of said top and bottom panels, each side wall panel comprising a set of upper and lower panels having edges hingedly connected to edges of said top and bottom panels respectively along associated edges thereof, each set of upper and lower panels being hingedly interjoined along interconnection edges thereof, and being adjacently disposed outwardly from said top and bottom panels when said container is in collapsed condition; and means for rendering rigid the container in expanded condition, said means being releasable to permit collapse of the container, said upper and lower panels defining outwardly extending side edges for engagement with corresponding outwardly extending side edges of adjacent side wall panels, whereby the respective upper and lower panels, when engaging adjacent side wall panels as said container is in fully-expanded condition, define an angle with each other of less than 180°, to prevent inward collapsing of said side wall panels.

2. A collapsible container comprising: substantially identical oppositely disposed top and bottom panels, each having at least three edges thereof, a pair of side wall panels for each of said edges, each said pair comprising upper and lower panels having edges hingedly connected to said top and bottom panels respectively, along associated edges thereof, said upper and lower panels being hingedly interjoined along interconnection edges thereof and being adjacently disposed outwardly of said top and bottom panels when said container is collapsed; tube means disposed along each of said interconnection edges, and a string means disposed within said tube means, whereby drawing said string means serves to erect said container by retracting said side wall panels inwardly to vertically separate said top and bottom panels.

3. The collapsible container of claim 2 wherein said panels are made of a relatively rigid material.

4. The collapsible container of claim 3 wherein at least one of said top and bottom panels comprises an access door hingedly disposed therewith.

5. The collapsible container of claim 4 wherein said access door is retained in generally flush relationship with its associated panel by means of retaining tabs attached thereto on the interior side thereof.

6. The collapsible container of claim 4 wherein said access door comprises a tab handle.

7. The collapsible container of claim 2 wherein said top and bottom panels are rectangular in shape.

8. The collapsible container of claim 2 wherein each of said edges of each side wall panel is coextensive with said edge hingedly connected thereto, said side wall panels in each said pair thereof being substantially identical in size, said pairs being disposed in end-to-end relationship upon retraction thereof to form a closed container.

9. The collapsible container of claim 8 wherein said interconnection edges of said side wall panels are longer than said other hingedly connected edges, whereby said side wall panels are disposed outwardly of said top and bottom panels upon container erection.

10. The collapsible container of claim 2 wherein said tube means are disposed along said interconnection edges exteriorly of said side wall panels.

11. The collapsible container of claim 10 wherein one of said tube means comprises two spatially separated tube sections and a bead for threadedly receiving the two free ends of said string means.

12. The collapsible container of claim 2 wherein all of said pairs are integrally formed with one of said top and bottom panels, the other of said panels being integrally formed with one of said pairs.

13. The collapsible container of claim 2 wherein one of said side wall panels comprises a rotatable handle, said string means having free ends thereof connected to opposite sides of said handle, whereby rotation of said handle serves to retract said pairs inwardly to erect said container.

14. A collapsible container having
a base panel;

a plurality of polygon-shaped side panels, each of which side panels is pivotally mounted to the base panel along a straight pivot edge thereof, said pivot edges of said plurality of said panels themselves being disposed in a polygon arrangement on said base panel, said side panels being pivotable from a collapsed position generally parallel with the base panel to an erect position wherein they are at an angle to the base panel and have their side edges meeting and abutting against the next adjacent side panel; and selectively releasable rigidifying means defining a polygonal frame member adapted to be releasably affixed about the side panels.

15. A collapsible container defining:

a base panel;

a plurality of polygon-shaped side wall panels, each side wall panel being pivotally mounted to the base panel along a straight pivot edge thereof, said pivot edges of said side panels being disposed in a polygonal arrangement on said base panel, said side wall panels being pivotable between a collapsed position, generally parallel with the base panel, and an erect position wherein said side wall panels are in angular relationship to said base panel, said side wall panels defining outwardly extending side edges adapted for meeting and abutting in erect position against the outwardly extending side edges of adjacent side wall panels, whereby, in said erect, abutting position, said side wall panels define an angle of greater than 90° and less than 180° with said base panel, and exhibit improved resistance against inward collapse; and selectively releasable means for retaining said container in its erect position, said means defining a retaining member positioned above the base panel and coupled to said side wall panels when said side wall panels are in said erect position.

16. The invention of claim 15 wherein said means for retaining said container in its erect position is a flexible, but relatively non-elastic, elongated draw member (55) in a draw channel on the side wall panels.

17. The invention of claim 14 wherein two base panels are provided, a top and a bottom panel, each of which base panel has a plurality of polygon-shaped side panels as defined in that claim, with respective ones of said side panels hinged to said bottom panels, and respective ones of said side panels hinged to the top panels, also being hinged together, and wherein said rigidifying means serves to rigidify both sets of side panels in their erect positions.

* * * * *